US007824598B1

(12) United States Patent
Kim

(10) Patent No.: US 7,824,598 B1
(45) Date of Patent: Nov. 2, 2010

(54) VERTICAL-CAST CONCRETE COLUMN FORMS AND PANEL ELEMENTS AND METHOD OF FABRICATION

(76) Inventor: Sun Y. Kim, 2384 Lancaster Ct., Hayward, CA (US) 94542

( * ) Notice: Subject to any disclaimer, the term of this patent is extended or adjusted under 35 U.S.C. 154(b) by 974 days.

(21) Appl. No.: 11/642,478

(22) Filed: Dec. 20, 2006

(51) Int. Cl.
*B28B 3/00* (2006.01)

(52) U.S. Cl. ..... 264/333; 264/31; 264/336; 249/48; 249/50; 249/51; 249/125; 249/128; 249/129; 249/130; 249/136; 249/142; 249/144; 249/145; 249/158; 249/160; 249/176; 249/188

(58) Field of Classification Search ..... 264/333, 264/336; 249/175, 144, 141
See application file for complete search history.

(56) References Cited

U.S. PATENT DOCUMENTS 4,790,508 A * 12/1988 Henderson et al. ..... 249/11
5,866,026 A * 2/1999 Johnston ..... 249/119
5,902,528 A * 5/1999 Spragg ..... 264/42
2006/0022112 A1* 2/2006 Ishler ..... 249/77

* cited by examiner

*Primary Examiner*—Philip C Tucker
*Assistant Examiner*—Amjad Abraham

(57) ABSTRACT

A system for forming thin-wall pre-cast concrete forms and structures, using vertical casting and slip-form techniques to partition wet concrete into separate thin-wall sections, the system being particularly useful for fabricating pre-cast concrete column forms having a composition and vertical consistency substantially the same as the integral poured concrete core of the finished concrete column.

5 Claims, 2 Drawing Sheets

VERTICAL-CAST CONCRETE COLUMN FORMS AND PANEL ELEMENTS AND METHOD OF FABRICATION

BACKGROUND OF THE INVENTION

This invention relates to a system for thin-wall casting of concrete structures, particularly thin-wall concrete forms for poured concrete columns and thin-wall panels, usable individually as panel elements or paired as concrete forms for concrete walls.

Typically, concrete columns are cast on the building site using wooden or metal forms that are laboriously erected on site around a network of steel reinforcing bar projecting from a base or footing. The use of a pre-cast concrete form that becomes an integral part of the poured concrete column would save considerable time in the formation of a structure, particularly where numerous columns are required in a building structure.

The use of wooden or metal forms requires considerable labor to assemble the forms and provide the bracing to withstand the hydrostatic pressure of the poured concrete, particularly as the height increases. Additional labor is required to remove and store, or dispose of, the form material after the poured concrete sets. The use of pre-cast concrete forms is clearly advantageous, given the rigid nature of cured concrete. However, the use of pre-cast concrete forms has the disadvantage of the material weight of concrete requiring the wall thickness to be minimized. Without the use of pressure injection or the use of expensive specialty concrete mixtures, the fabrication of relatively lightweight pre-cast column forms is problematic and elusive. Although pre-cast column forms for poured in-place structures have been proposed, the pre-cast forms are typically cast as shell structures in horizontal form molds. Pairs of channel-like shell structures are coupled together with ties to form the vertical column forms. The resulting seams are undesirable, weaken the structure and require finishing for appearance. Additionally, horizontal pre-casting of the form elements results in a lack of perimeter uniformity when erected and interconnected as a column form.

The present invention provides a system of pre-casting column forms and other thin-wall structural elements in a vertical orientation, using a gravity flow pour of standard concrete, or concrete matching the specification of the ultimate column or structural member that is poured on site.

The fabrication system utilizes a slip form technique to achieve a thin wall in the resulting column forms or panels. In the case of the column form, the form can have a square, round or polygonal configuration depending on the desired cross-section of the finished column. The thin-wall panels may be advantageously used in spaced facing pairs with bracing for thicker poured-in-place concrete walls or for pedestals and footings.

These and other advantages in the vertical-cast thin-wall concrete column forms and vertical-cast, thin-wall panels will become apparent from the summary and detailed consideration of the preferred embodiments that follow.

SUMMARY OF THE INVENTION

The present invention is a system for fabricating thin-wall concrete forms and structures, using vertical casting and slip-form techniques to create thin-wall structures. The system is particularly advantageous for fabricating pre-cast concrete column forms that become part of the column when the form is filled with poured concrete at the construction site. The system is also useful for fabricating thin-wall panels which may be used alone, for example as a curtain wall, or in spaced apart pairs as forms for thicker poured concrete wall structures. In fabricating either product, a perimeter mold or outer form is used that is filled with poured concrete, preferably having the same compositional characteristics as the ultimate structure. Immediately, before the wet pour begins to set, thin internal dividers or form elements are pressed down into the perimeter mold in cookie cutter fashion to define the shape of the cast column form or panel.

In the case of the column form, the poured concrete trapped in the center of the form element is released before setting and used for other pre-cast forms or panels. In the case of the panels, the dividers are preferably fabricated of a stiff plastic from which the cured or partially cured panels can be easily separated, or are fabricated of a relatively rigid material coated with a film that prevents the concrete from adhering to the divider. Similarly, the perimeter mold or outer form and the form elements for complex structures, such as the concrete column form, may be fabricated of molded plastic or conventional form constructing materials, including wood and metal.

To improve the correct seating of form elements slipped into the perimeter mold or outer form, removable spacers can be inserted into the concrete pour and bracing can be added to spaces from which the concrete is subsequently vacated.

The vertical fabrication of pre-cast concrete forms for structures, such as bases, pedestals and particularly columns, can be accomplished with ordinary concrete, i.e., a mixture of Portland cement, sand and aggregate. Special slump concrete or pressure injection is not required to achieve the thin wall of the structures formed. Alternately, the concrete can be matched to the ultimate structure formed. Significantly, the pre-cast form will have a perimeter uniformity and a top-to-bottom wet-pour composition similar to the composition of the final structure's poured concrete interior.

DETAILED DESCRIPTION OF THE PREFERRED EMBODIMENTS

Figure 1:
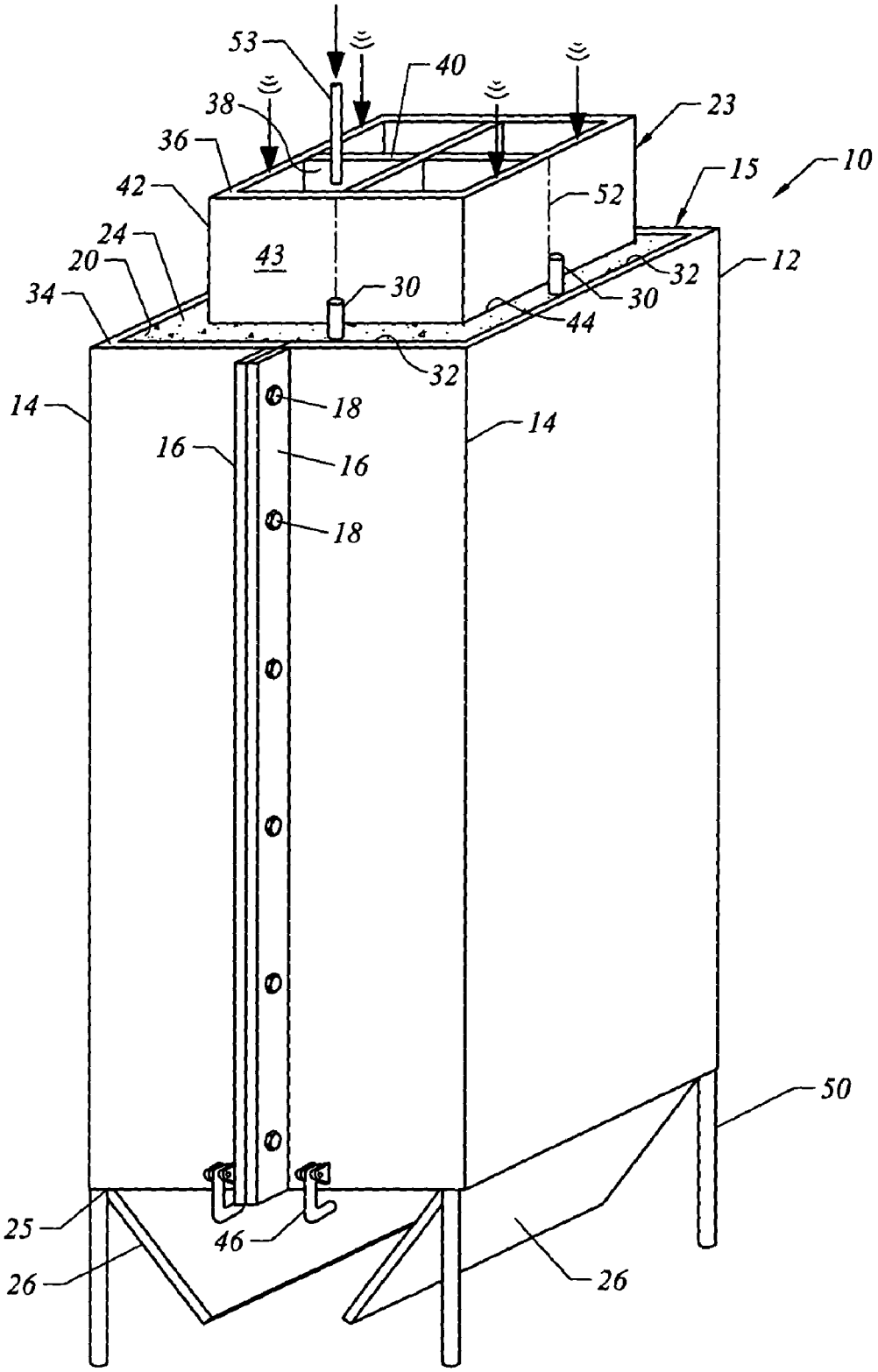
FIG. 1 is a perspective view of a pre-casting form system for a thin-wall pre-cast concrete form for columns.

The invented system of fabricating thin-wall concrete structures is described with reference to a first embodiment, shown in FIG. 1, for producing pre-cast concrete forms for columns. The system, generally identified by the reference numeral 10, includes a perimeter mold 12 formed of two half-shells 14, each having a vertical side flange 16 with bolts 18 retaining the half-shells 14 together to generically form an outer form unit 15 with an inside surface 20 configured to the desired outer contour of the final structure. The system in FIG. 1 is designed to produce a short column 22, shown in FIG. 2, having a square cross section. Other configurations may be produced by varying the configuration of the outer form unit 15 comprising the perimeter mold and an inner form unit 23 that defines the inside contours of cast column forms being produced. The perimeter mold 12 is preferably made of a relatively rigid polymer that is easily releasable from the produced cast column form 24 when the connecting bolts 18 are removed.

The perimeter mold 12 has a bottom with an underside lip 25 that forms a frame for two trap doors 26 that release the surplus poured concrete during formation of the pre-cast column form 24. The dimension of the underside lip 26 is approximately the thickness and contour of the vertical walls 27 of the pre-cast column form 24 and prevents the wet concrete forming the column form 24 from being discharged with the surplus concrete.

Production of the pre-cast, thin-wall column forms is accomplished by filling the perimeter mold 12 with preferably conventional concrete having aggregate with a maximum dimension sized to less than the minimal thickness of the wall 27 of a specified column form. Taller and wider columns require pre-cast column forms that are thicker than the approximately one inch thickness of a form for a short four foot column base or pedestal. Temporary spacer rods 30 are inserted at strategic locations, here at the center of the four sides 32 of the square outer form unit 15. The spacer rods 30 project above the top rim 34 of the outer form unit 15 when fully inserted to allow for convenient removal when appropriate. Immediately after filling the closed-door perimeter mold 12 with gravity supplied concrete and insertion of the spacer rods 30, the inner form unit 23 is installed.

The inner form unit 23 is installed by a downward press of the inner form unit 23 into the wet concrete contained in the perimeter mold 12. In FIG. 1, the inner form unit 23 is shown nearly installed with the top rim 36 of the inner form unit 23 approaching the top rim 34 of outer form unit 15. When the rims are even, the inner form unit 23 is fully installed. The spacer rods 30 guide the insertion of the inner form unit 23 until the inner form unit 23 seats on the underside lip 26 of the perimeter mold 12. The inserted inner form unit 23 divides the wet concrete into separated vertical volumes in the outer form unit 15.

The inner form unit 23 may include one or more internal cross braces 38 spaced along the length of the inside of the inner form unit 23. The blades 40 of the cross braces 38 add little resistance and preferably are installed contemporaneously with the box tube 42 of the form unit 23. The outside surface 43 of the box tube 42 defines the inside surface 44 of the produced pre-cast column form 24. To facilitate insertion of the inner form unit 23, the unit can be tapped or vibrated to aid in dislocating any blocking aggregate and easing installation. However, vibrational aid should be moderated to prevent the aggregate in the wet concrete from excessive settling.

It is to be understood that one objective of the vertical pour system of this invention is to match, as closely as possible, the vertical consistency of the column form with the vertical consistency of the column when using the same composition of concrete. However, in certain situations, it is recognized that it may be advantageous to use a different concrete mixture for the pre-cast column form; for example, where a protective shell is required for marine environments and the like. In both cases, excessive settling of the aggregate is preferably to be avoided.

Immediately after the inner form unit 23 is fully inserted, the spacer rods 30 are removed and the bottom of the perimeter mold 12 is opened by releasing the pivotal dog latches 46 and dropping the doors 26. The perimeter mold 12 is raised on legs 50 at each corner to allow the doors to drop and the wet core of concrete to be released to a container or conveyer (not shown) for re-use.

The column form 24, when partially cured and stable, is released from the outer form unit 15 and inner form unit 23. This is accomplished by removing the bolts 18 and separating the two half-shells of the outer form unit 15, and removing the cross braces 38 and deforming the box tube 42 along the deflection lines 52 at the center of the sides of the inner form unit 23. This can be accomplished by inserting thin rods 53 between the curing form 24 and the outside of the box tube 42. The partially collapsed box tube 42 is then withdrawn from the hollow core.

Figure 2:
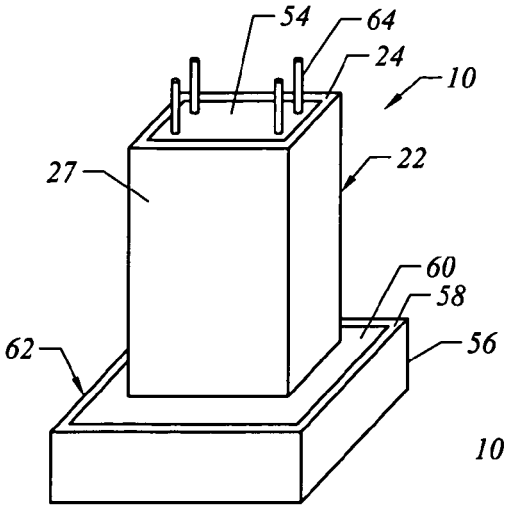
FIG. 2 is a perspective view of a concrete column and base using the form system of FIG. 1.

As shown in FIG. 2, the short column 22 has an inner poured concrete core 54 and an outer pre-cast concrete form 24 that is integral with the core 54. The horizontal consistency of the cured concrete around the perimeter of the concrete form 24 is uniform and without seams. The vertical composition of the form 24 is substantially the same as the core 54. The short column 22 is integral with a pre-poured based 56, which is formed with a pre-cast base form 58 and an on-site poured concrete core 60. The resulting structure 62 includes steel re-bar 64 as required. Since the base 56 is essentially a short column, the term column form will be used for bases, pedestals and columns. The column forms produced by the invented system are without seams and can therefore withstand a high hydrostatic pressure, thereby allowing the forms to have a minimum wall thickness. While the column forms 24 can be fabricated on the construction site, the minimized weight of the forms allows the forms to be fabricated off-site under idealized conditions, using multiple column form molds with minimal transportation costs for the finished pre-cast forms.

Figure 3:
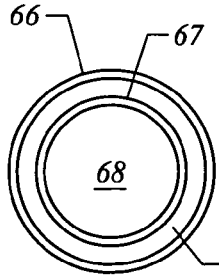
FIG. 3 is a top view of an alternate embodiment of a pre-casting form system for a thin-wall pre-cast concrete form for cylindrical columns.

It is to be understood that other outer and inner form unit constructions can be utilized. For example, as shown in FIG. 3, in forming cylindrical columns, an outer spiral wrapped cardboard tube 66 and an inner spiral wrapped cardboard tube 67, displaced from the outer tube 66, can be used as outer and inner vertical form units. After filling the outer tube 66 with concrete, inserting the inner tube 67 and removing any spacer rods as necessary, the core concrete 68 in the inner tube is vacated. The tubes are subsequently removed by unwrapping when the pre-cast column form 69 is sufficiently cured. In this instance, no bracing is required and the cardboard form units are easily separated from the cast column form. Although the form units are destroyed, this is a relatively insignificant cost and is particularly adapted for cylindrical columns.

Figure 4:
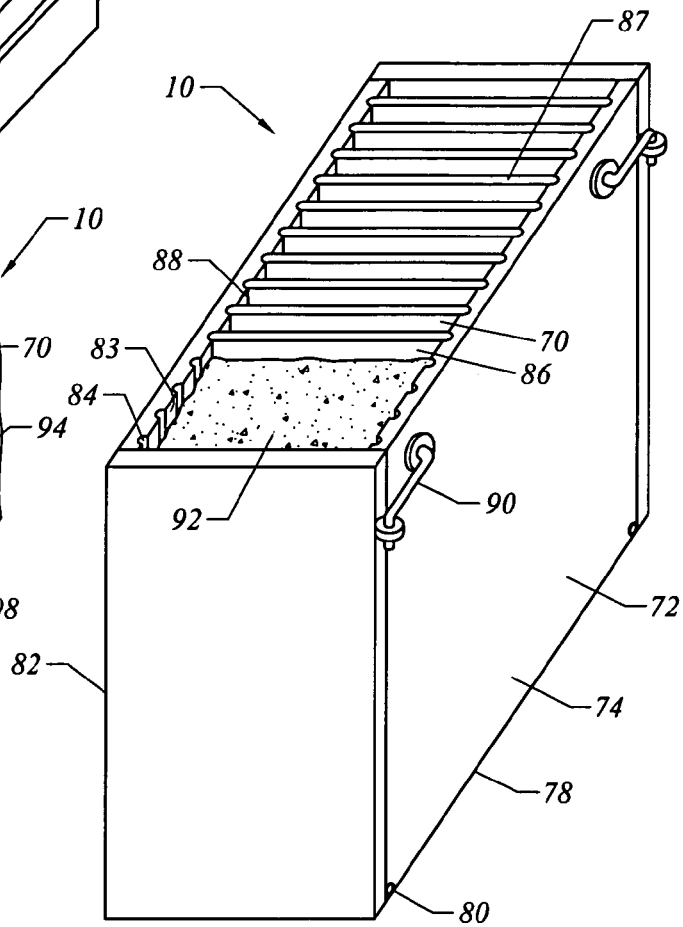
FIG. 4 is a perspective view of a pre-casting form system for a thin-wall pre-cast concrete panel for wall structures.

Referring now to FIG. 4, there is illustrated another embodiment of a thin-wall concrete structure fabricated by this system. The system of this invention is applied to forming thin-wall panels 70, which are particularly useful as vertical forms for poured concrete walls of thickness, substantially greater than the panels. The vertical-pour batch system for a plurality of panels includes a perimeter panel mold 72 with elongated rectangular sides 74 and rectangular ends 76 connected to a bottom 78, preferably by hinges 80. The perimeter panel mold 72 comprises an outer form unit 82 in the form of a rectangular container. The inside surface 83 of the sides 74 has a series of equally spaced arcuate slots 84 which, on oppositely facing sides, provide for insertion of a series of parallel dividers 86. The series of rectangular dividers 86 comprise the inner form unit 87. The dividers 86 have rounded, vertical edges 88 that engage the arcuate slots 84 and hold the dividers in place.

To fabricate the panels, the panel mold 72 with upright sides 74 and ends 76 locked in place by dog latches 90 is filled with gravity-poured concrete 92. The dividers 86 are then inserted. The dividers 86 are preferably thin, stiff plastic sheets that easily slip into the wet concrete and are subsequently easily separated from the set concrete after partial or complete curing.

After the concrete has sufficiently set to be self supporting, the dog latches 90 are released and the sides and ends are lowered. When the panels 70 have cured enough to avoid breakage during handling, the panels 70 are separated, one by one, from the dividers 86. The panels 70 are then trimmed to remove any roughage and removed to an appropriate environment for optimum curing.

Figure 5:
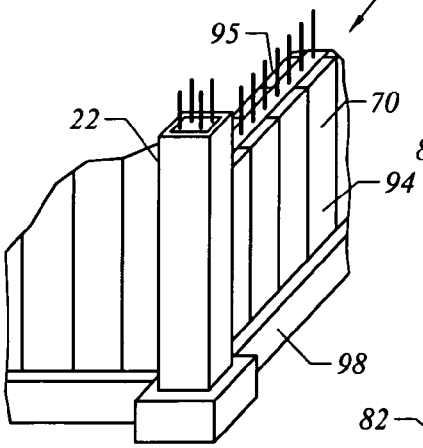
FIG. 5 is a partial perspective view of a column and wall structure formed using the thin-wall pre-cast form system of this invention.

As noted, a preferred use of the panels 70 is for poured wall structures 94 where opposed spaced panels 70, appropriately braced or tied, provide integral vertical pre-cast forms 95 for poured concrete walls 96 or horizontal forms for footings 98. The wall structure 94 of FIG. 5 is preferably used with a column 22 and base, constructed as previously described to illustrate an advantageous combination. Alternately, the panels 70 can be used as curtain walls or in other wall structures.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. A method for forming thin-wall concrete structures adapted for concrete forms comprising the steps:

providing an outer form unit with sides and a bottom wherein the sides and bottom form a container;

filling the outer form unit with poured wet concrete;

providing an inner form unit;

inserting the inner form unit downwardly into the wet concrete in the outer form unit wherein the wet concrete is divided into separated vertical volumes;

releasing one of the separated vertical volumes of wet concrete through the bottom of the outer form;

partially curing the concrete to form one or more concrete structures;

removing the outer form unit and inner form unit from the partially cured concrete structure; and, curing the concrete structure.

2. The method of claim 1 wherein the outer form unit has a vertical perimeter wall and the inner form unit has a vertical perimeter wall displaced from the vertical perimeter wall of the outer unit wherein the concrete structure comprises a pre-cast concrete column form.

3. The method of claim 1 wherein the inner form unit, when inserted in the outer form unit, divides the wet concrete into a vertical core volume within the inner form unit and a vertical perimeter volume between the inner form unit and the outer form unit.

4. The method of claim 3 wherein the concrete is released from the vertical core volume.

5. The method of claim 3 including spacing the inner form unit from the outer form unit and bracing the inner form unit.

* * * * *